US012595927B2

(12) United States Patent
Wallace et al.

(10) Patent No.: US 12,595,927 B2
(45) Date of Patent: Apr. 7, 2026

(54) METHOD TO CONTROL CLEANROOM CONDITIONS

(71) Applicant: ENERGY EFFICIENCY CONSULTANCY GROUP LIMITED, Macclesfield (GB)

(72) Inventors: Robert Wallace, Macclesfield (GB); Shuji Chen, Macclesfield (GB)

(73) Assignee: ENERGY EFFICIENCY CONSULTANCY GROUP LIMITED, Macclesfield (GB)

( * ) Notice: Subject to any disclaimer, the term of this patent is extended or adjusted under 35 U.S.C. 154(b) by 608 days.

(21) Appl. No.: 18/062,443

(22) Filed: Dec. 6, 2022

(65) Prior Publication Data

US 2023/0116873 A1 Apr. 13, 2023

Related U.S. Application Data

(63) Continuation-in-part of application No. 16/311,338, filed on Dec. 19, 2018, now abandoned.

(51) Int. Cl.
*F24F 3/163* (2021.01)
*F24F 11/47* (2018.01)
(Continued)

(52) U.S. Cl.
CPC ..... *F24F 11/54* (2018.01); *F24F 11/47* (2018.01); *F24F 11/63* (2018.01); *F24F 11/74* (2018.01);
(Continued)

(58) Field of Classification Search
CPC ..... F24F 3/163; F24F 3/167; F24F 2110/65; F24F 2110/10
See application file for complete search history.

(56) References Cited

U.S. PATENT DOCUMENTS 5,538,471 A 7/1996 Guiles
5,544,809 A * 8/1996 Keating ..... F24F 11/46 236/47
(Continued)

FOREIGN PATENT DOCUMENTS

EP 2527755 A2 11/2012
WO 2006099125 A2 9/2006

*Primary Examiner* — Mohammad Ali
*Assistant Examiner* — Vincent W Chang
(74) *Attorney, Agent, or Firm* — Craft Chu PLLC; Andrew W. Chu

(57) ABSTRACT

The method to control cleanroom conditions, including zone particle concentration, occupancy status, and heating, ventilation, and air conditioning (HVAC) system conditions, includes detecting a zone particle concentration, an occupancy status, and HVAC system conditions. The cleanroom includes the HVAC system in communication with the zone of the cleanroom and with a computer processor as a control unit of the cleanroom. The zone particle concentration, the occupancy status, and the HVAC system conditions are communicated to the computer processor, and a desired zone particle concentration is determined based on a range of desired HVAC system conditions with model predictive control. A first control signal to the HVAC system based on the occupancy status, the zone particle concentration, and the desired zone particle concentration is determined. The first control signal is communicated to the HVAC system, and the HVAC system activates according to the first control signal.

20 Claims, 9 Drawing Sheets

(51) Int. Cl.

| | |
|---|---|
| ***F24F 11/54*** | (2018.01) |
| ***F24F 11/63*** | (2018.01) |
| ***F24F 11/74*** | (2018.01) |
| *F24F 110/65* | (2018.01) |
| *F24F 120/10* | (2018.01) |

(52) U.S. Cl.
CPC ..... *F24F 2110/65* (2018.01); *F24F 2120/10* (2018.01)

(56) References Cited

U.S. PATENT DOCUMENTS

2006/0234621 A1* 10/2006 Desrochers ..... F24F 3/044 702/50
2008/0277486 A1* 11/2008 Seem ..... H04L 67/125 236/49.3
2010/0102135 A1* 4/2010 Alles ..... F24F 11/62 236/49.1
2010/0235004 A1* 9/2010 Thind ..... G05B 15/02 700/277
2012/0065783 A1* 3/2012 Fadell ..... F24F 11/30 703/7
2013/0085613 A1* 4/2013 Bester ..... F24F 11/65 165/59
2013/0324026 A1* 12/2013 Fiorita, Jr. ..... B01L 1/04 454/239
2014/0132415 A1 5/2014 Churchvara
2014/0260692 A1* 9/2014 Sharp ..... F24F 11/74 73/863.23
2014/0277757 A1* 9/2014 Wang ..... F24F 11/46 700/276
2014/0365017 A1* 12/2014 Hanna ..... F24F 11/65 700/276
2015/0032264 A1* 1/2015 Emmons ..... F24F 11/0001 700/276
2015/0056909 A1* 2/2015 Chien ..... F24F 11/30 454/187
2015/0370927 A1* 12/2015 Flaherty ..... F24F 11/30 703/1
2016/0063833 A1 3/2016 Schultz
2016/0076780 A1 3/2016 Lotz
2017/0030603 A1* 2/2017 Barooah ..... F24F 11/30

* cited by examiner

METHOD TO CONTROL CLEANROOM CONDITIONS

CROSS-REFERENCE TO RELATED APPLICATIONS

The present application claims priority under 35 U.S.C. Section 120 from U.S. patent application Ser. No. 16/311,338, filed on 19 Dec. 2018, entitled "CLEANROOM CONTROL SYSTEM AND METHOD". See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a method to control cleanroom conditions. The present invention also relates to controlling a heating, ventilation and air conditioning (HVAC) system of a cleanroom based on particle concentration, occupancy, and model predictive control.

2. Description of Related Art Including Information Disclosed Under 37 CFR 1.97 and 37 CFR 1.98

A cleanroom is an environment, typically used in manufacturing or scientific research, that has a low level of environmental pollutants such as dust, airborne microbes, aerosol particles and chemical vapors for critical environment applications and research. More specifically, a cleanroom has a controlled level of contamination that is specified by the number of particles per cubic meter at a specified particle size.

The conventional cleanroom system 1 of the prior art is shown in FIG. 1. This known cleanroom system 1 can currently maintain the required air cleanliness for the range of standard cleanrooms. For perspective, the ambient outside air in a typical urban environment contains 35,000,000 particles per cubic meter having a particle diameter greater than 0.5 μm, suitable for an International Standards Organization (ISO) 14644-1 Class 9 cleanroom. For the most critical environment applications, an ISO Class 1 cleanroom is defined as allowing not more than 10 particles of 0.1 μm diameter and greater per cubic meter.

As a typical cleanroom of FIG. 1, the prior art cleanroom system 1 comprises a number of zones or rooms of varying cleanliness ISO classifications, as required. The highest rated zone or room, in this case zone 2, which is an ISO Class 5 cleanroom is at the furthest point from the main door entry 3. It is adjoined to a "dirtier" less clean cleanliness classification room or zone 4, which in this example is an ISO Class 7 cleanroom, via a gown/ungown room 5. Entry to room 4 being made through airlock entry 6. As known by one skilled in the art, the ISO Class 5 cleanroom 2 is kept at a higher air pressure (known as a "pressure cascade") to prevent contaminants from the adjacent ISO Class 7 cleanroom 4 that would enter through the gown/ungown room 5. This pressure differential is maintained by the supply of filtered and conditioned air, which flows through the inflows 7. Exfiltration/exhaust air is taken from outflows 8. The inflows 7 and outflows 8 are controlled by the HVAC cleanroom control system 1, as described in more detail below.

The majority of cleanrooms that have been designed since the 1950s are based on a fixed air volume system that are generally over-designed to supply more air than is required to meet the relevant classification and cover the risk of not maintaining the classification due to lack of continuous information. Whilst cleanroom clothing and standard operating procedures have improved greatly since the inception of cleanrooms, comparable advances in control systems have hitherto not been made.

This results in much higher energy costs than is actually needed for operating the cleanroom. There is a strong commercial need for a control system which maintains the strict air cleanliness requirements of the cleanroom, whilst optimizing the energy performance of the cleanroom's HVAC system. Any such control system which addresses this problem serves two major purposes: first, helping to reduce the energy costs of the cleanroom, and second helping companies adopt a more sustainable stance boosting their public image.

Energy efficiency activities are rare in cleanrooms; however they present a very real opportunity in terms of energy savings. The energy requirements of cleanrooms are immense: in some cases, up to 80% of the energy consumed is required by the HVAC system to control temperature and humidity as well as to filter out particles and maintain pressure control. The integrity of the cleanroom environment is also dependent upon maintaining a positive or negative pressure, created by the HVAC system.

Until recently, energy efficiency has been of little concern to cleanroom operations as energy prices were low. As Good Manufacturing Practice (GMP) compliance is of the utmost importance in the manufacture of food and pharmaceutical products, for example, most companies in these sectors had been willing to accept whatever energy is required to maintain the HVAC system performance and ensure resulting compliance. This has made it hitherto difficult for cleanroom operators to reduce energy costs in HVAC systems.

It is estimated that high technology manufacturers in the UK alone spend £200 million on energy for their cleanroom operations and very few pharmaceutical cleanroom operations have any mitigation in place to reduce HVAC energy consumption. However, with rising energy prices, and a desire for more sustainable products, plant operators are very keen on finding ways to reduce energy consumption without sacrificing plant performance.

Several strategies have already been proposed for the control of HVAC cleanroom systems. Existing control systems are frequently independent of each other and are dedicated to subsystems or groups of subsystems for example: ventilation, heating and cooling, humidification, and pressurization.

One of the HVAC control systems available in the art is described in US 2013/0324026 A1. US 2013/0324026 A1 provides a cleanroom control system and method that reduces the energy consumed by the air handling system of the cleanroom at times when the cleanroom was not in use. It also provides a cleanroom control system and method that enables the air handling system of the cleanroom to return to an operation state (where the air handling system operates at full capacity) from a low or reduced state upon demand or at predetermined times.

There are still problems with known control systems of this type. They do not provide the aforementioned control and flexibility to maintain cleanroom integrity and significantly reduce energy costs.

Model Predictive Control (MPC) uses a system model to predict the future states of the system and generates a control vector that minimizes a certain factor, such as cost or energy consumption, over the prediction horizon in the presence of disturbances and constraints. The first element of the computed control vector at any sampling instant is applied to the system input, and the remainder is discarded. The entire process is repeated in the next time instant. The certain factor can take the form of tracking error, control effort, energy cost, demand cost, power consumption, or a combination of these factors. Constraints can be placed on the rate and range limits of the equipment at issue and the manipulated and controlled variables. MPC has been applied in self-driving vehicle technology, drill bit guidance in oil and gas exploration, and rocket and satellite deployment. Any system, that relies on the baseline logic of sensor data, either real time or archived or both, being modeled to reach a desire result, applies computer programming and algorithms based on MPC.

A cleanroom and cleanroom conditions have particular considerations, such as upper and lower limits of the zone temperature, supply airflow rate limits, and range and speed limits for damper positioning. There are external and internal disturbances acting on the system due to weather, occupant activities, and equipment use that are unique to control of cleanroom conditions. A cleanroom is not a missile nor a drill bit nor a self-driving vehicle. The known MPC methods for these other technologies are insufficient for controlling cleanroom conditions. The control unit as a computer processor must be robust to both time-varying disturbances and specific system parameters of a cleanroom in order to regulate cleanroom conditions.

It is an object of the present invention to provide a method to control cleanroom conditions which overcomes or reduces the drawbacks associated with known products of this type. The present invention provides a method to control cleanroom conditions that can be used with, or retrofitted to, a HVAC cleanroom system, which can save 50% or more of a cleanroom's energy costs whilst maintaining the desired air quality levels.

It is an object of the present invention to integrate all of the cleanroom's operations, including ventilation, heating, cooling, room pressure, and filtration.

It is an object of the present invention to have a computer processor as a control unit for complex algorithms developed to take into account cleanroom usage, demand and user activities and/or energy prices.

It is an object of the present invention to self-adapt for maintaining the area or zone of the cleanroom in the required condition in the most energy efficient and cost effective manner.

It is a further object of the present invention to provide a cleanroom control method for a system that will continuously capture, and act upon, data from airborne particle counters, temperature/humidity sensors, differential pressure sensors, occupancy sensors, room pressure sensors, airborne molecular contamination (AMC) sensors, particle deposition sensors and microbiological sensors.

It is another object of the present invention to integrate the present invention into an existing building management system (BMS). The present invention is compatible for communication, integration and/or interoperability with other third party products. Use of the present invention provides a flexible, modular and scalable system which can be suitable for retrofit and stand-alone installations.

The present invention uses open standards and application programming interfaces (API) for communication.

It is another object of the present invention to provide a method to control cleanroom conditions that includes detecting zone particle concentration, occupancy status and heating, ventilation, and air conditioning (HVAC) system conditions.

It is another object of the present invention to provide a method to control cleanroom conditions that includes determining a desired zone particle concentration with model predictive control based on a range of desired HVAC system conditions. The model predictive control includes variables, such as energy costs, past monitoring, past usage, usage patterns and forecasts, response time, and guaranteed air cleanliness and quality.

It is another object of the present invention to provide a method to control cleanroom conditions that includes determining a control signal to the HVAC system based on occupancy status, zone particle concentration, and the desired zone particle concentration.

It is still another object of the present invention to provide a method to control cleanroom conditions continuously in real time.

It is still another object of the present invention to provide a method to control cleanroom conditions.

The control system being flexible enough to be expanded upon or altered as the cleanroom environment changes.

BRIEF SUMMARY OF THE INVENTION

The present invention is a method to control cleanroom conditions: zone particle concentration, occupancy status, and heating, ventilation, and air conditioning (HVAC) system conditions. The HVAC system conditions are conditions that are directly affected by an HVAC system, such as air flow rate, air pressure, temperature, and humidity. The HVAC system is comprised of ducting, an air handling unit, and an air volume device, and at least parts of the HVAC system can be part of an existing building management system. The method includes detecting a first zone particle concentration in a zone of a cleanroom with a particle sensor, a first occupancy status in the zone of the cleanroom with an occupancy sensor, and heating, ventilation, and air conditioning (HVAC) system conditions in the zone of the cleanroom with a plurality of HVAC sensors. The cleanroom is comprised of the HVAC system in communication with the zone of the cleanroom and with a computer processor as a control unit or controller of the cleanroom. The first zone particle concentration, the first occupancy status, and the HVAC system conditions are communicated to the computer processor, and a first desired zone particle concentration in the zone is determined according to the first occupancy status with the computer processor based on a range of desired HVAC system conditions. A first control signal to the HVAC system based on the first occupancy status, the first zone particle concentration, and the first desired zone particle concentration is determined with model predictive control by the computer processor. The first control signal is communicated to the HVAC system, and the HVAC system activates according to the first control signal.

Embodiments of the present invention include continuous real time control of the cleanroom conditions. After the step of activating the HVAC system according to the first control signal, the embodiment of the method further includes detecting a second zone particle concentration in the zone of the cleanroom with the particle sensor within the zone of the cleanroom, detecting a second occupancy status in the zone of the cleanroom with the occupancy sensor within the zone of the cleanroom, and detecting second HVAC system conditions in the zone of the cleanroom with the plurality of HVAC sensors. The second zone particle concentration, the second occupancy status, and the second HVAC system conditions are communicated to the computer processor. When the first occupancy status and the second occupancy status are identical, a second control signal to the HVAC system is based on the first occupancy status, the second occupancy status, the first zone particle concentration, the second zone particle concentration, the first control signal, and the first desired zone particle concentration. When the first occupancy status is different from the second occupancy status, a second desired zone particle concentration in the zone based on the range of desired HVAC system conditions with the computer processor according to the second occupancy status is determined so that the second control signal to the HVAC system is now further based on the second occupancy status, the first control signal, and the second desired zone particle concentration. The method can be repeated for a third step of detecting zone particle concentration, occupancy status, and HVAC conditions. The time between the steps of detecting can be at intervals or continuous, and the step of determining the desired zone particle concentrations can be based on past zone particle concentrations and past control signals. The occupancy status determines whether a new desired zone particle concentration is determined by the computer processor or control unit. Model predictive control can be used for this step of determining the desired zone particle concentration and the control signal to the HVAC system.

The present invention includes the HVAC system being comprised of an air duct, an air handling unit, and an air volume device, which can be constant (CAV) or variable (VAV) devices or both. The air handling unit can be comprised of a pre-filter, a secondary filter, a main air blower, a temperature device and a high-efficiency particulate air (HEPA) filter element. The temperature device can be comprised of a heating element or a cooling element or both. In some embodiments, the HVAC system is a part of an overall building management system. The air duct, the air handling unit, and the air volume device of older infrastructure can be adapted for the present invention.

Embodiments of the present invention include the step of determining the first desired zone particle concentration being further based on a predictive model for the HVAC system conditions. Factors, such as energy savings and cost efficiency, can be used to determine the desired zone particle concentrations and control signals of the present invention.

DETAILED DESCRIPTION OF THE INVENTION

The present invention is a method to control cleanroom conditions that can be used with a heating, ventilation and air conditioning (HVAC) system to save energy and costs while still maintaining the requirements of any classification of the International Standards Organization (ISO) 14644-1. The method innovates conventional model predictive models for the unique requirements and characteristics of a cleanroom. The present invention incorporates the primacy of the occupancy status as determinative for cleanroom conditions and control signals. Additionally, the conventional air flow exchange rate is replaced by zone particle concentration so that control signals are not based solely on moving air. Other conditions affecting zone particle concentration, such as temperature, can be changed by other devices, such as heating elements, instead of only fans for moving air. The present invention can be adapted for continuous real time data and time interval data. The present invention can be retrofit into existing building management systems. The method further includes learning from past desired particle concentrations and past control signals. The present invention can maintain a zone of the cleanroom in the required condition in the most energy efficient and cost effective manner.

Figure 1:
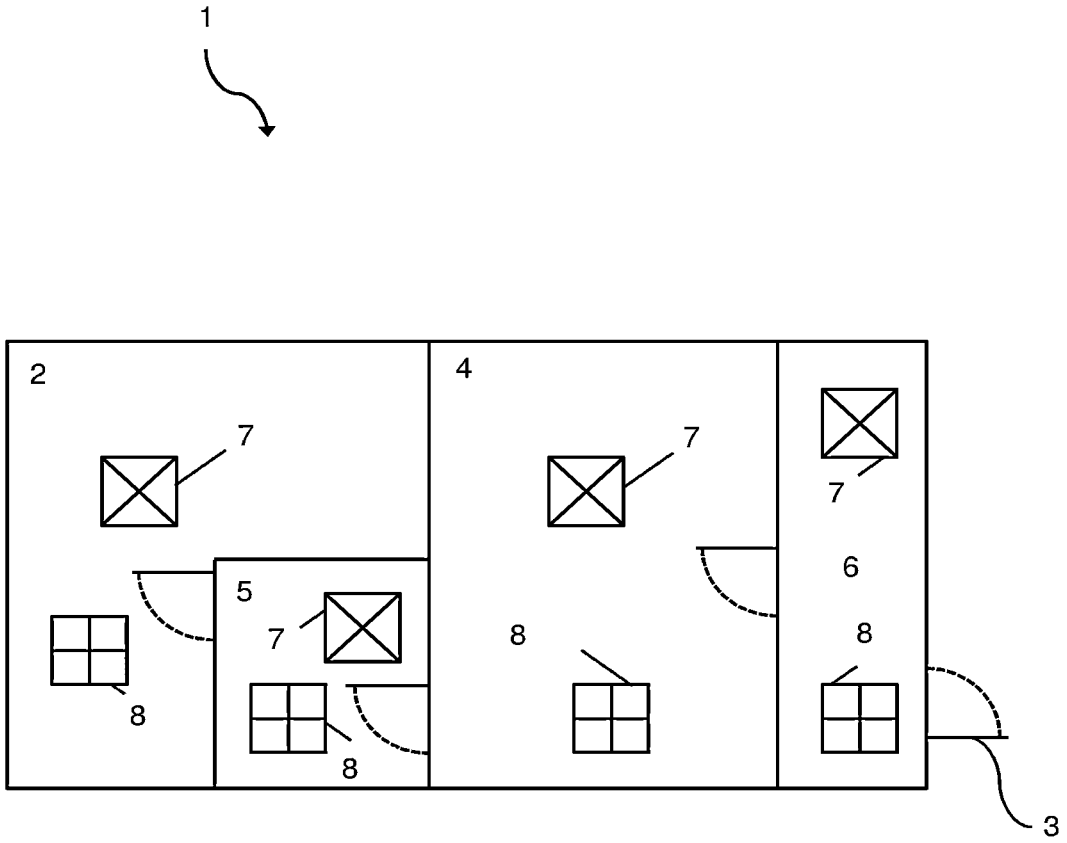
FIG. 1 PRIOR ART
FIG. 1 is a schematic view of a prior art cleanroom system.
Figure 2:
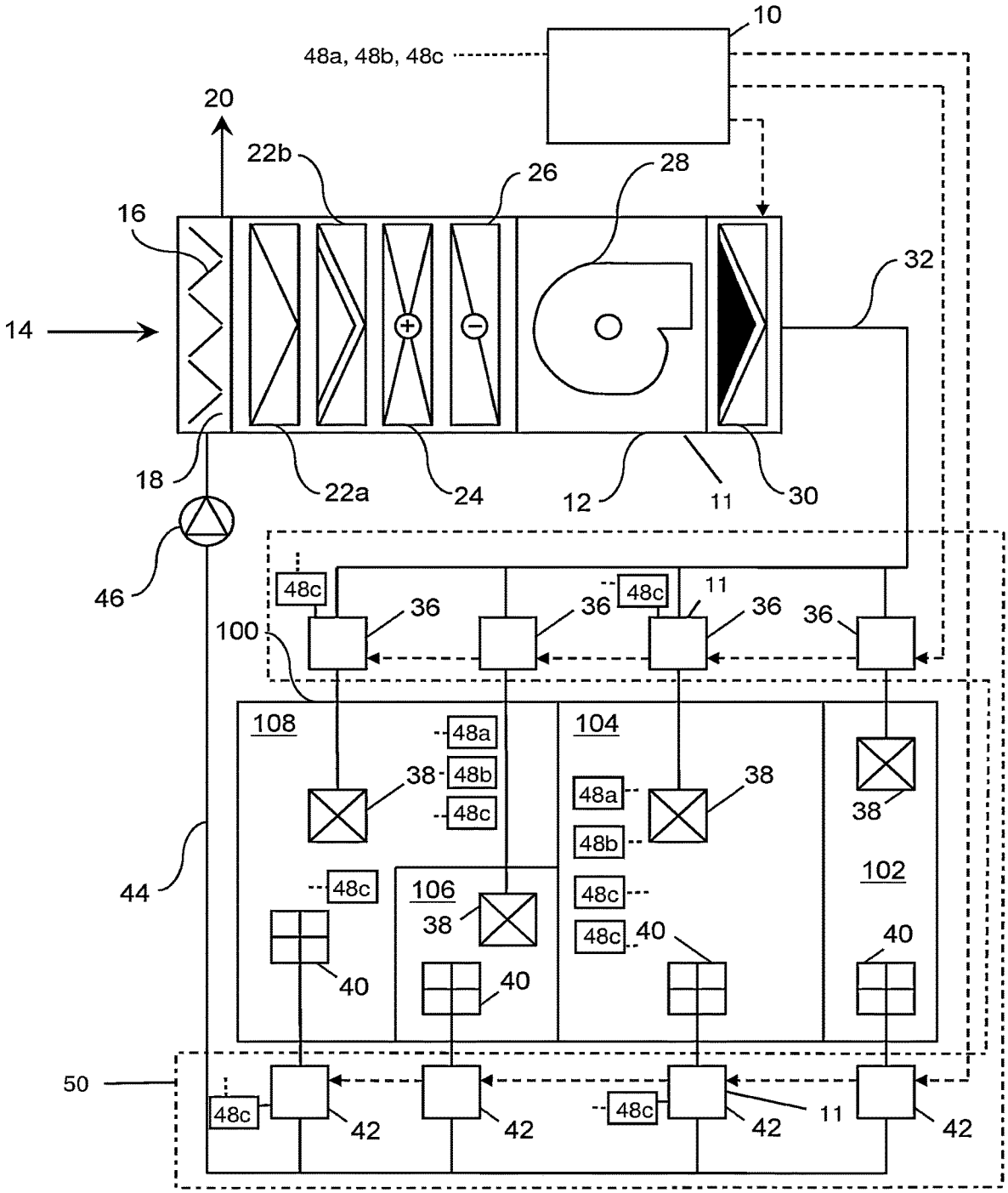
FIG. 2 shows a schematic view of a cleanroom and HVAC system for the method of the present invention.
Figure 3:
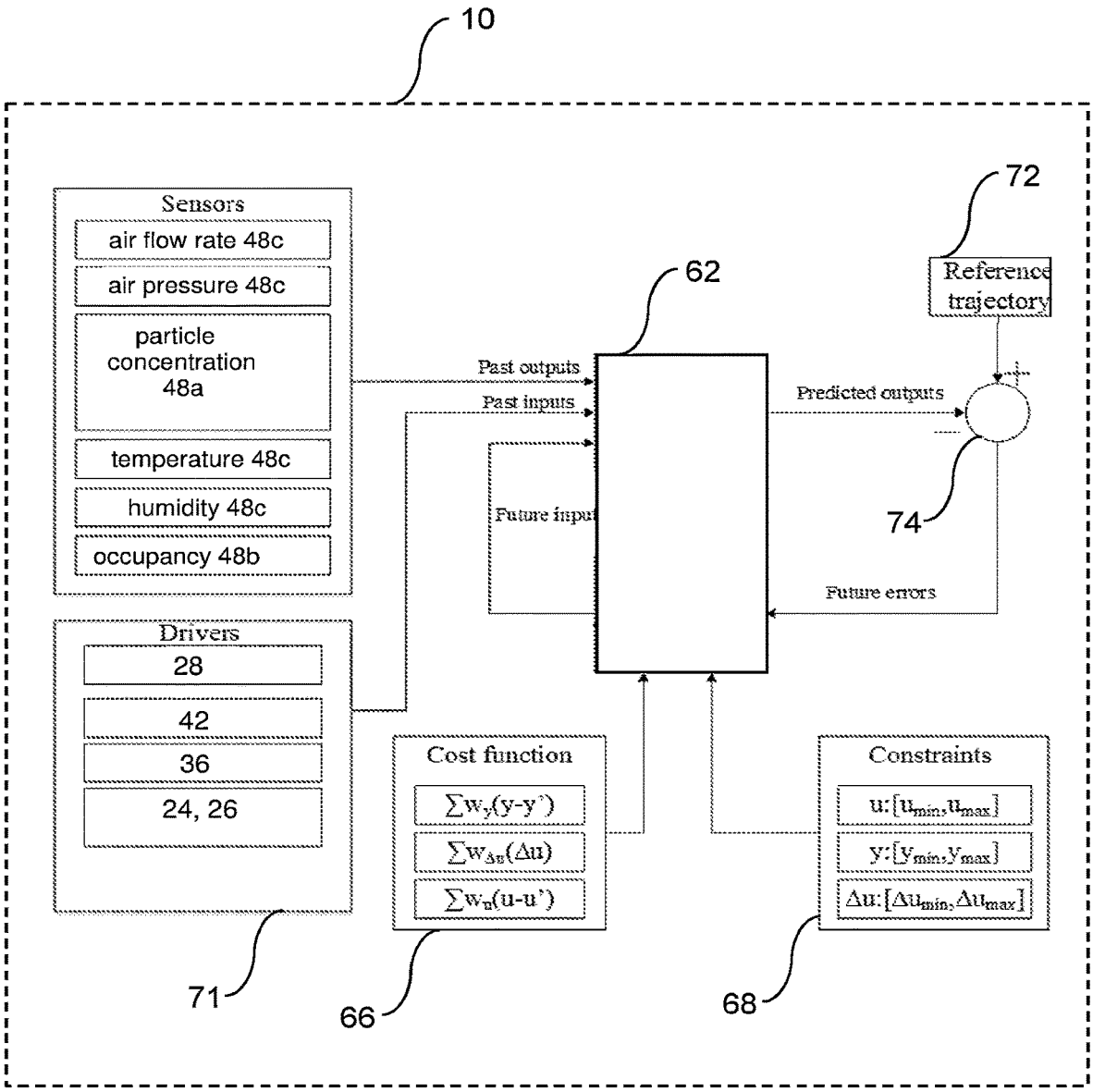
FIG. 3 shows a schematic view of a computer processor as a model predictive controller (MPC) for the cleanroom and HVAC system of the method of the present invention.

FIGS. 2-3 show the method to control cleanroom conditions of the present invention. The cleanroom conditions are occupancy status, zone particle concentration, and heating, ventilation, and air conditioning (HVAC) system conditions. The occupancy status is the cleanroom condition that is controlled by the user, and the other cleanroom conditions must be adjusted according to the occupancy status.

The cleanroom 100 of the present invention includes zones 102, 104, 106, 108. An HVAC system 11 is connected to the cleanroom 100 and includes an air duct 32, 44, an air handling unit 12, and an air volume device 36, 42. There are air ducts 32 from air handling unit 12 and air ducts 44 to the air handling unit 12. The air volume devices 36, 42 can be a constant air volume (CAV) device 36 or a variable air volume (VAV) device 42. Each zone 102, 104, 106, 108 has a zone inlet 38 and a zone outlet 40. The zone inlets 38 and zone outlets 40 can be distribution grills for delivering air. FIG. 2 shows a check valve 46 in the air duct 44 to the air handling unit 12.

An embodiment of the method of the present invention includes detecting a first zone particle concentration in a zone 104, 108 of a cleanroom 100 with a particle sensor 48*a* within the respective zone of the cleanroom, a first occupancy status in said zone of said cleanroom with an occupancy sensor 48*b* within the respective zone of the cleanroom, and heating, ventilation, and air conditioning (HVAC) system conditions in the respective zone of the cleanroom with a plurality of HVAC sensors 48*c*. The HVAC system conditions are air flow rate, air pressure, temperature, and humidity. An HVAC sensor 48*c* of the plurality of HVAC sensors 48*c* can be an air flow rate sensor, an air pressure sensor, a temperature sensor, a humidity sensor or other known sensor for HVAC conditions.

The cleanroom 100 is comprised of an HVAC system 11 in communication with the respective zone of the cleanroom and with a computer processor 10 as a control unit or controller. The computer processor 10 has a known programmable logic controller (PLC), memory, power management, and network capability to analyze data, calculate results, generate instructions, and transmit those instructions. The computer processor 10 or control unit has model predictive control functionality.

The particle sensor 48*a*, the occupancy sensor 48*b*, and the plurality of HVAC sensors 48*c* are in communication with the computer processor 10. The method of the present invention includes the steps of communicating the first zone particle concentration, the first occupancy status, and the HVAC system conditions to the computer processor.

The method of the present invention further includes determining a first desired zone particle concentration in the zone based on a range of desired HVAC system conditions according to the first occupancy status with the computer processor 10 and determining a first control signal to the HVAC system 11 based on the first occupancy status, the first zone particle concentration, and the first desired zone particle concentration. The first control signal is communicated to the HVAC system 11; and the HVAC system 11 is activated according to the first control signal to achieve the first desired zone particle concentration.

Embodiments of the present invention include the first control signal corresponding to the air handling unit 12, the constant air volume device 36, and the variable air volume device 42. In particular, as shown in FIG. 3, the first control signal corresponds to drivers 71 for the air handling unit 12, the constant air volume device 36, and the variable air volume device 42. The HVAC system 11 can only adjust the HVAC conditions in order to achieve the desired zone particle concentration for the range of HVAC conditions possible for the cleanroom, according to the occupancy status. Thus, the overall cleanroom conditions are controlled by the present invention. In some embodiments, a building management system (BMS) 50 is comprised of at least one of the air duct 32, 44, the air handling unit 12, and the air volume device 36, 42. The HVAC system 11 can be retrofit into existing buildings so that the method of the present invention is compatible with infrastructure new built or pre-existing.

With regard to the air handling unit 12, the first control signal can be directed to any component of the air handling unit 12. FIG. 2 shows the air handling unit being comprised of an air handling unit inlet 14, a pre-filter 22*a*, a secondary filter 22*b*, a main air blower 28, a temperature device 24, 26 and a high-efficiency particulate air (HEPA) filter element 30. The temperature device 24, 26 can be comprised of a heating element 24, a cooling element 26 or both. The first control signal can activate the main blower 28 for a new air flow rate or the heating element 24 for a higher temperature air flow. Instead of being based only on the air exchange rate of the prior art, the present invention based on the zone particle concentration can be controlled by more than fan speed for the air exchange rate. The energy efficiency or cost efficiency is no longer based on the single dimension of air exchange rate by fan speed. The present invention allows an improved energy efficiency or cost efficiency based on the different components of the air handling unit 12, such that the main blower 28 is no longer the only determinant of the control signal.

FIG. 3 shows the computer processor 10 as a Model Predictive Control (MPC) controller in communication with the sensors 48*a*, 48*b*, 48*c* and drivers 71 of the HVAC system 11, including the main air blower 28, the temperature devices 24, 26, and the air volume devices 36, 42. As in FIG. 3, the computer processor 10 as MPC controller receives the first zone particle concentration from the particle concentration sensor 48*a*, the first occupancy status from the occupancy sensor 48*b*, and various HVAC system conditions from the HVAC sensors 48*c*, shown as airflow rate, air pressure, temperature, and humidity. A modelling program 62 gathers the sensor data as past outputs. FIG. 3 also shows the drivers 71 of the HVAC system 11, including the air handling unit 12, the constant air volume device 36, and the variable air volume device 42. The past control signals given to the HVAC system 11 or at least the drivers 71 of the HVAC system 11 are also considered by the modelling program 62 as past inputs.

The modeling program 62 determines the first desired particle concentration as any classification of the International Standards Organization (ISO) 14644-1, but the constraint is a range of desired HVAC system conditions achievable by the HVAC system 11. For example, the minimum and maximum speed of the main blower 28 and the minimum and maximum temperature increase of the heating element 24 constrain the ability of the cleanroom 100 to meet or maintain any classification of the International Standards Organization (ISO) 14644-1.

FIG. 3 also shows the modeling program 62 with a cost function 66, constraints 68, future input, and future errors, according to the first occupancy status. The cost functions 66 are the sum of the difference between the current past outputs and the desired cleanroom conditions for ISO classification. In FIG. 3, wy is a weighting coefficient; the sum of the increment of past inputs; w$\Delta$u is a weighting coefficient; and the sum of the input and a particular value, wu is a weighting coefficient. The constraints 68 are the upper limit and lower limits of the input u, the output y and the increment rate of the input. The difference 74 between the predicted outputs and a reference trajectory 72, is defined as future errors. The modeling program 62 includes predicted outcomes from the future input and future errors. Unlike known control algorithms, such as Proportional Integral (PI) control, the present invention has predictive ability. The modelling program 62 can limit first desired particle concentration by the past outputs and past inputs by constraints 68. In the present invention, the modelling program 62 limits the first control signal according to the first occupancy status and can then further limit by the cost function 66.

Embodiments of the step of determining the first desired zone particle concentration and the first control signal can rely on the modeling program 62 to capture the process dynamics to precisely predict the future outputs and be simple to implement and understand. As model predictive control is not a "one size fits all" approach, but rather a set of different methodologies, and there are many types of models that could be used to predict the system behavior. The modeling program 62 is a fundamental part of the control of the present invention. If the cost function 66 is quadratic, its minimum can be obtained as an explicit function (linear) of past inputs, past outputs, and the future reference trajectory. In the presence of inequality constraints, the solution must be obtained by more complex numerical algorithms. The steps of determining the first desired zone particle concentration and the first control signal depend on the number of variables and the prediction horizons used.

FIGS. 2-3 also show embodiments of the present invention for continuous real time operation of the cleanroom 100.

After the step of activating the HVAC system according to the first control signal, the method further comprises the steps of: detecting a second zone particle concentration in the zone 104, 108 of the cleanroom 100 with the particle sensor 48*a* within the respective zone of the cleanroom, a second occupancy status in the zone of the cleanroom with the occupancy sensor 48*b* within the respective zone of the cleanroom, and second HVAC system conditions in the respective zone of the cleanroom with the plurality of HVAC sensors 48*c*. The second zone particle concentration, the second occupancy status, and the second HVAC system conditions are also communicated to the computer processor 10.

When the first occupancy status and the second occupancy status are identical, the method includes the step of determining a second control signal to the HVAC system based on the first occupancy status, the second occupancy status, the first zone particle concentration, the second zone particle concentration, the first control signal, and the first desired zone particle concentration. The method includes communicating the second control signal to the HVAC system; and activating the HVAC system according to the second control signal. In this embodiment, the occupancy status has remained the same in continuous real time or in the next time interval. That is, the cleanroom 100 has remained empty or the cleanroom 100 has remained occupied by the same number of individuals. The first desired zone particle concentration for the ISO classification is unchanged so the method does not require a second desired zone particle concentration.

After the step of activating the HVAC system according to the second control signal, the method further comprises the steps of: detecting a third zone particle concentration in the zone 104, 108 of the cleanroom 100 with the particle sensor 48*a* within the respective zone of the cleanroom, a third occupancy status in the zone of the cleanroom with the occupancy sensor 48*b* within the respective zone of the cleanroom, and third HVAC system conditions in the respective zone of the cleanroom with the plurality of HVAC sensors 48*c*. The third zone particle concentration, the third occupancy status, and the third HVAC system conditions are also communicated to the computer processor 10.

When the first occupancy status, the second occupancy status, and third occupancy status are identical, the method includes the step of determining a third control signal to the HVAC system based on the first occupancy status, the second occupancy status, the third occupancy status, the first zone particle concentration, the second zone particle concentration, the third zone particle concentration, the first control signal, the second control signal and the first desired zone particle concentration. The method includes communicating the third control signal to the HVAC system; and activating the HVAC system according to the third control signal. In this further embodiment, the occupancy status has remained the same in continuous real time or in the next time intervals. That is, the cleanroom 100 has remained empty or the cleanroom 100 has remained occupied by the same number of individuals. The first desired zone particle concentration for the ISO classification is unchanged so the method does not require a second desired zone particle concentration, even after the third desired zone particle concentration.

Alternatively, after the step of activating the HVAC system according to the first control signal, the method further comprises the steps of: detecting a second zone particle concentration in the zone 104, 108 of the cleanroom 100 with the particle sensor 48*a* within the respective zone of the cleanroom, a second occupancy status in the zone of the cleanroom with the occupancy sensor 48*b* within the respective zone of the cleanroom, and second HVAC system conditions in the respective zone of the cleanroom with the plurality of HVAC sensors 48*c*. The second zone particle concentration, the second occupancy status, and the second HVAC system conditions are also communicated to the computer processor 10.

When the first occupancy status and the second occupancy status are different, the method includes the step of determining a second control signal to the HVAC system based on the first occupancy status, the second occupancy status, the first zone particle concentration, the second zone particle concentration, the first control signal, the first desired zone particle concentration and a second desired zone particle concentration. In this embodiment, the occupancy status has changed in continuous real time or in the next time interval. That is, the number of individuals in the cleanroom 100 has changed. The second desired zone particle concentration for the ISO classification is needed because the HVAC system must adjust to account for the different number of individuals in the cleanroom 100. The method also includes communicating the second control signal to the HVAC system; and activating the HVAC system according to the second control signal. This embodiment illustrates the primacy of the occupancy status beyond prior art systems based on model predictive control. The present invention is an innovation for how to account for the unique characteristics of a cleanroom into a model predictive control system.

Occupancy status can change at any time.

After the step of activating the HVAC system according to the second control signal, the method further comprises the steps of: detecting a third zone particle concentration in the zone 104, 108 of the cleanroom 100 with the particle sensor 48*a* within the respective zone of the cleanroom, a third occupancy status in the zone of the cleanroom with the occupancy sensor 48*b* within the respective zone of the cleanroom, and third HVAC system conditions in the respective zone of the cleanroom with the plurality of HVAC sensors 48*c*. The third zone particle concentration, the third occupancy status, and the third HVAC system conditions are also communicated to the computer processor 10.

When the first occupancy status and the second occupancy status are identical, but the third occupancy status is different, the method includes the step of determining a third control signal to the HVAC system based on the first occupancy status, the second occupancy status, the third occupancy status, the first zone particle concentration, the second zone particle concentration, the third zone particle concentration, the first control signal, the second control signal, the first desired zone particle concentration, and a second desired zone particle concentration.

In this further embodiment, the occupancy status has changed in continuous real time or in the next time interval. That is, the number of individuals in the cleanroom 100 has changed. The second desired zone particle concentration for the ISO classification is needed because the HVAC system must adjust to account for the different number of individuals in the cleanroom 100. The third control signal is now based on the second desired particle concentration.

The method also includes communicating the third control signal to the HVAC system; and activating the HVAC system according to the third control signal. This embodiment repeats the primacy of the occupancy status beyond prior art systems based on model predictive control and demonstrates learning or adaptation. This embodiment of the present invention is a further innovation for how to account for the unique characteristics of a cleanroom into a model predictive control system.

Figure 4:
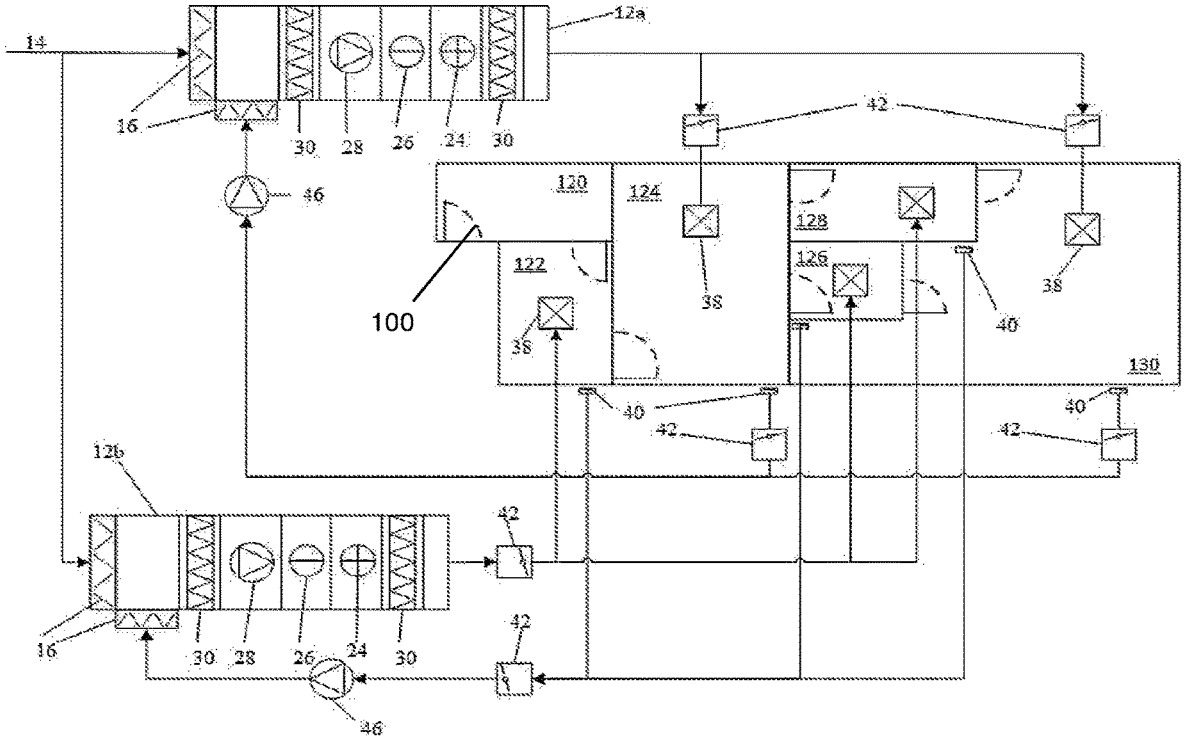
FIG. 4 is a schematic illustration of a typical cleanroom supplied by two separate HVAC air handling units and controlled according to the present invention.

FIG. 4 is illustrative of a typical cleanroom 100 supplied by two separate HVAC air handling units 12*a*, 12*b* and controlled by the MPC controller 10, and which has been used to develop the methodology of the present invention. Unlike FIG. 2, the cleanroom 100 of FIG. 4 has two separate AHUs 12*a*, 12*b* which allow a wide variety of performance testing options. The testing experiments are taken in the cleanroom 100 via the HVAC system. The HVAC system cleans and circulates the air drawn from outside of the cleanroom 100, the functionality of which is achieved by the operation of hardware including AHUs 12*a*, 12*b*, VAVs 42, extract ductwork 44, sensors, grilles 38 and diffusers 40, as described previously.

This typical cleanroom 100 is configured having an entrance 120 which leads into an ISO Class 7 change room 122. From the change room 122 is a zone or small room 124 which is an ISO Class 7 cleanroom 124. Between the Class 7 cleanroom 124 and a larger ISO Class 5 cleanroom 130 are a series of material pass rooms and airlock 126 and a large lab change room 128 which is a Class 5 change room. As with FIG. 2, the Class 5 cleanroom 130 is operated at higher pressure than the Class 7 cleanroom 124. The cleanroom 100 in the example of FIG. 6 has its highest rated room, in this case the larger room 130, at the furthest point from the main door entry 110. It is adjoined to the "dirtier" cleanliness classification smaller room 124, via a change room 122.

The skilled person will appreciate that the Class 5 cleanroom 130 is kept at a higher air pressure (known as a "pressure cascade") to prevent contaminants from, say, the adjacent Class 7 cleanroom 124. Such a configuration has been used to validate the model 62 and gives significant improvement in terms of dynamic response and efficiency, as described and shown in FIGS. 5 to 9.

A simple test was devised to challenge the standard BMS 50 cleanroom control against the particle-based MPC based controller as computer processor 10. All the following dynamic test results are obtained following the same test protocol as set out in Table 1.

TABLE 1

Experimental test protocol; personnel donning cleanroom garb

| Timeline (minutes) | Behaviour | No. of personnel |
|---|---|---|
| 0 | Class 7 level guard up and enter the room 124, stay and walk around. Note: hair and, where relevant beard and moustache, should be covered. A two-piece trouser suit, gathered at the wrists and with high neck and appropriate overshoes should be worn. They should shed virtually no fibres or particulate matter. | 3 |
| 15 | Class 5 level guard up and enter the room 130, stay and walk around. Note: headgear should totally enclose hair and, where relevant, beard and moustache. A boiler suit is worn with face mask to prevent the shedding of droplets. Appropriate sterilized, non-powdered rubber or plastic gloves should be worn. Bootees should be worn with the trouser leg tucked in. Garment sleeves should be tucked into the gloves. The protective clothing should shed virtually no fibres or particulate matter and retain particles shed by the body. | 2 |
| | Stay in room 124, walk around | 1 |
| 30 | Leave the cleanroom | 3 |

Figure 7:
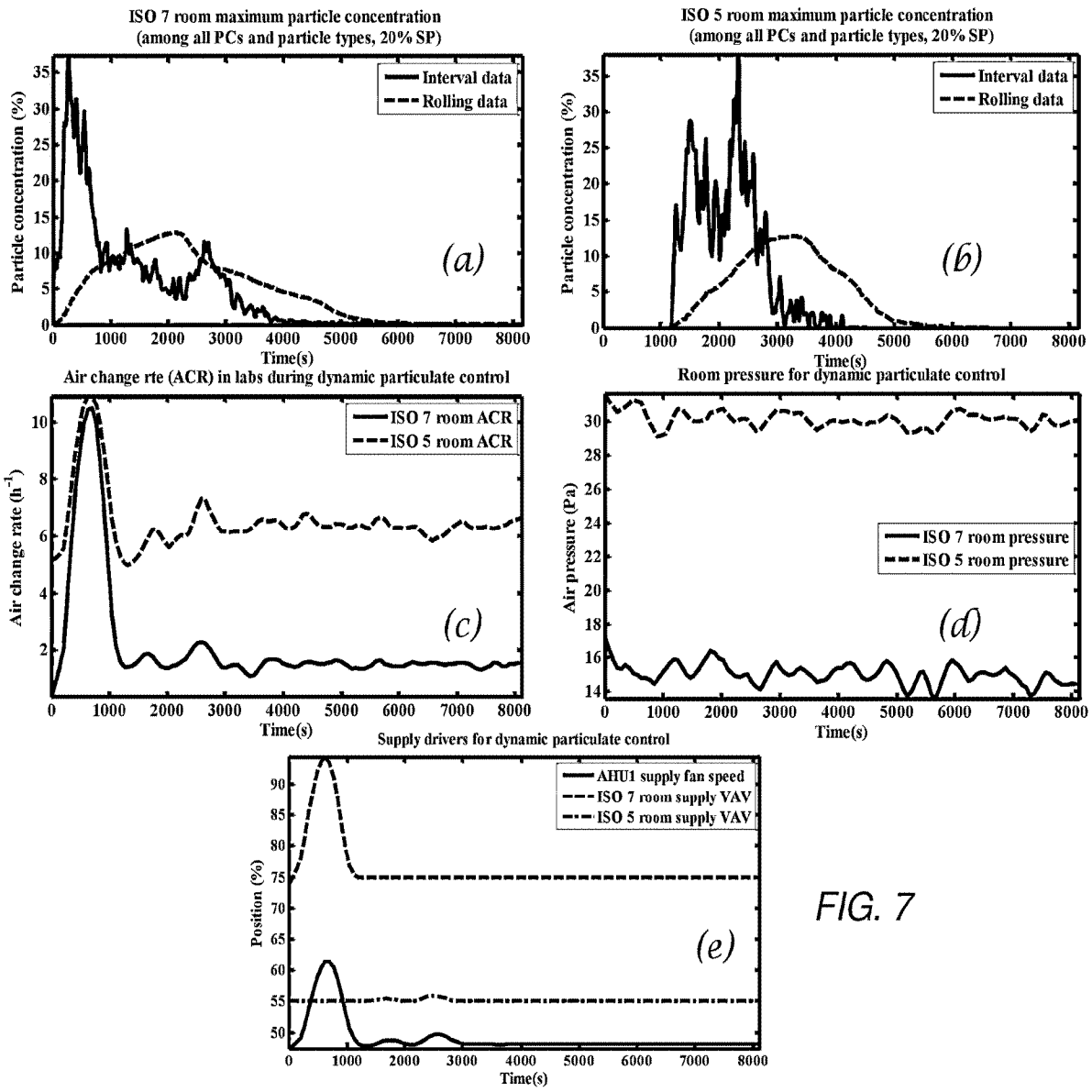
FIG. 7 shows a graph illustration of the dynamic response of the cleanroom control system of the present invention in response to the same experimental test of FIGS. 5 and 6, based on a first optimal setting value.

FIG. 7 shows comparative data obtained from the cleanroom of FIG. 4, and shows particle concentrations measured in various rooms of the cleanroom 100 in accordance with the experimental test defined in Table 1, the test data showing the response of a known BMS 50 control system which is based on a Proportional-Integral (PI) control algorithm.

The PI controllers implemented in the BMS 50 maintain the air change rate (ACR) for each room 124, 130 at a steady state. The ACR rates were fixed at 17 ACR/h for the ISO 7 room 124, and 40 ACR/h for the ISO 5 room 130 (and termed ACR1 in Table 2). At same time, the air pressure in each lab is kept constant at 15 Pa in the ISO 7 room 124, and 30 Pa in the ISO 5 room 130.

Two particle sizes are analysed: 0.5 μm and 5 μm. Room 124 has one particle counter, and room 130 has two particle counters, PC2 and PC3.

FIGS. 5-8 also make reference to interval data and rolling data. This is obtained as described below: The particle counters continuously sample air at a fixed sampling rate. The size of the air sample is therefore determined by the length of the measurement interval. The standard flow rate is 1.0 cubic feet per minute, which limits the allowable concentration of particles to 1 million per cubic foot (CF) or 35.3 million per cubic meter (CM). The sample volume can be collected in CF mode or CM mode. The sample time for the CF mode is 1 minute whereas the sample time for the CM mode is 35.3 minutes, such that in FIGS. 5 to 8:

Interval data— 60 times more frequently than the full sample volume, based on 1/60 of the total sample volume, updated every 35.3 s; and Rolling data—the totalized counts, particle concentration over a continuous sample volume, not an increasing number of particles for the current sample, updated every 35.3 s.

Figure 5:
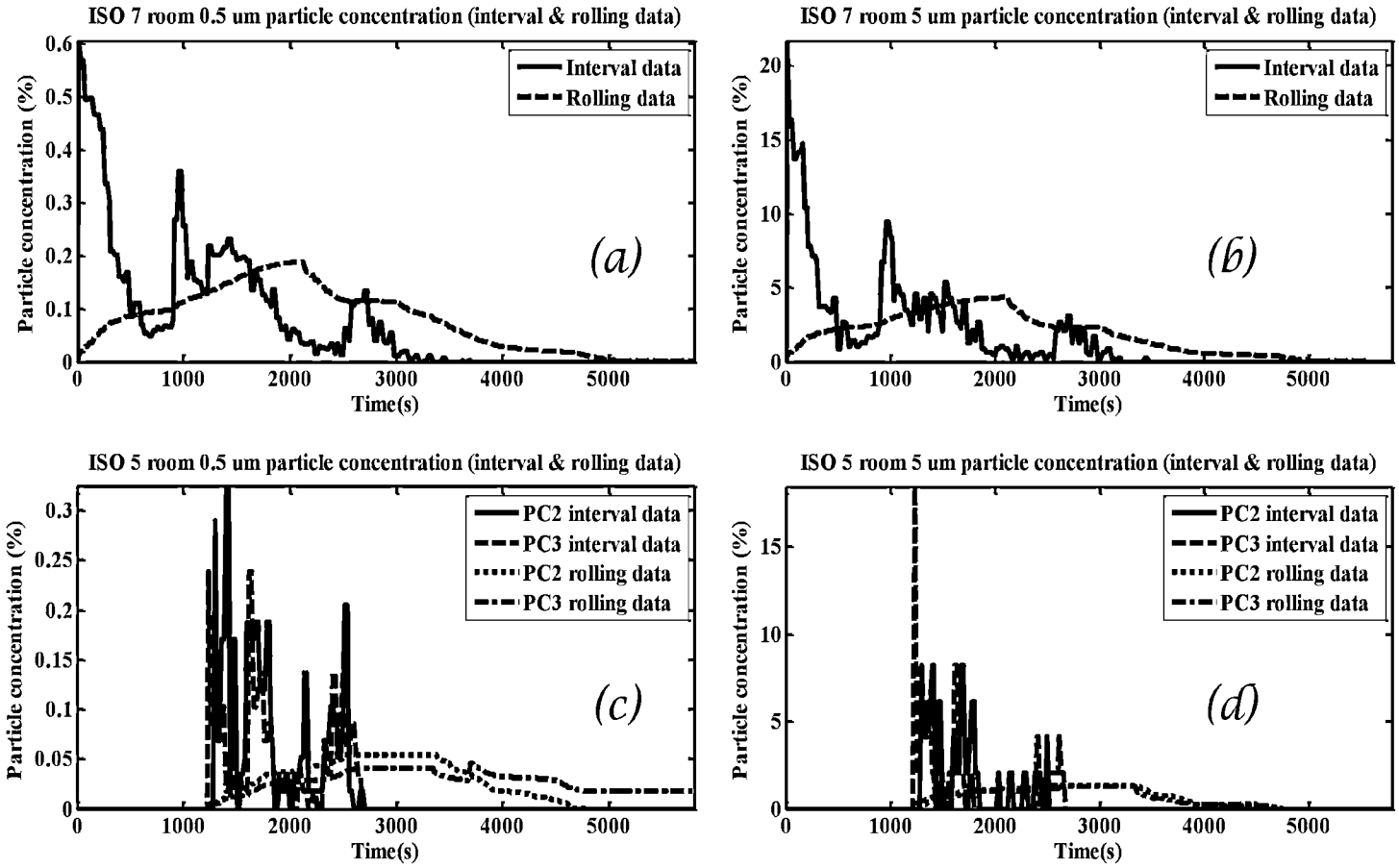
FIGS. 5 and 6 show graph illustrations of comparative data obtained from the cleanroom of FIG. 4 and shows particle concentrations measured in various zones of the cleanroom to the experimental test defined in Table 1, the test data showing the response of a known BMS control system which is based on a Proportional-Integral (PI) control algorithm.

FIG. 5(*a*) shows the ISO 7 room 124 0.5 μm particle concentration; FIG. 5(*b*) shows the ISO 7 room 124 5 μm particle concentration; FIG. 5(*c*) shows the ISO 5 room 130 0.5 μm particle concentration; and FIG. 5(*d*) shows the ISO 5 room 130 5 μm particle concentration. It can be clearly seen that the known BMS 50 control system, which is based on a Proportional-Integral (PI) control algorithm, takes a significant time lag to bring the particle count down in the various rooms 124, 130.

Figure 6:
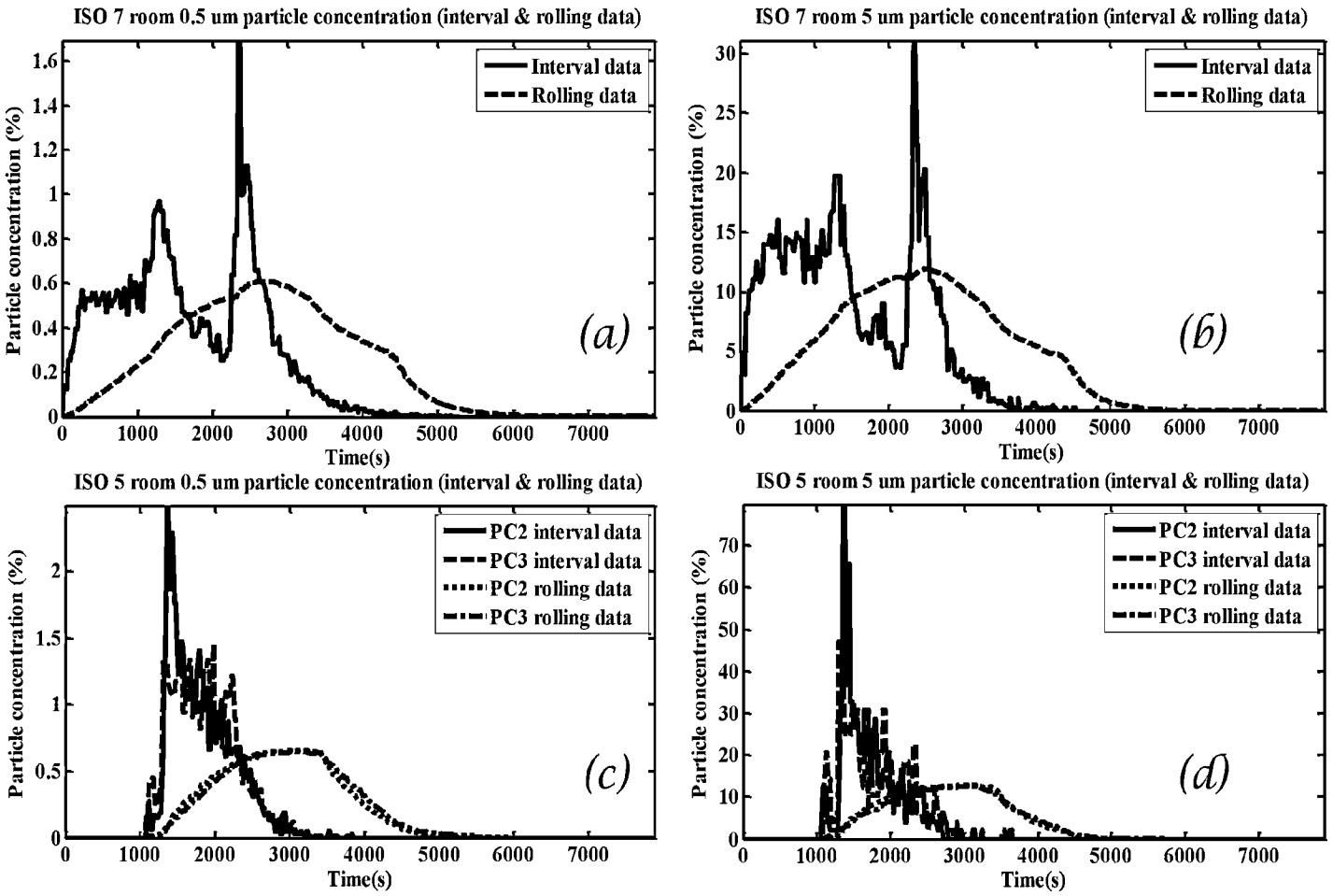

FIG. 6 shows the same BMS 50 control system operating at another ACR (termed ACR4 in Table 2) and being fixed at 3 ACR/h for the ISO 7 room 124 and 10 ACR/h for the ISO 5 room 130. Again, the Proportional-Integral (PI) control algorithm takes a significant time to reduce the particle count down in rooms 124, 130.

Figure 8:
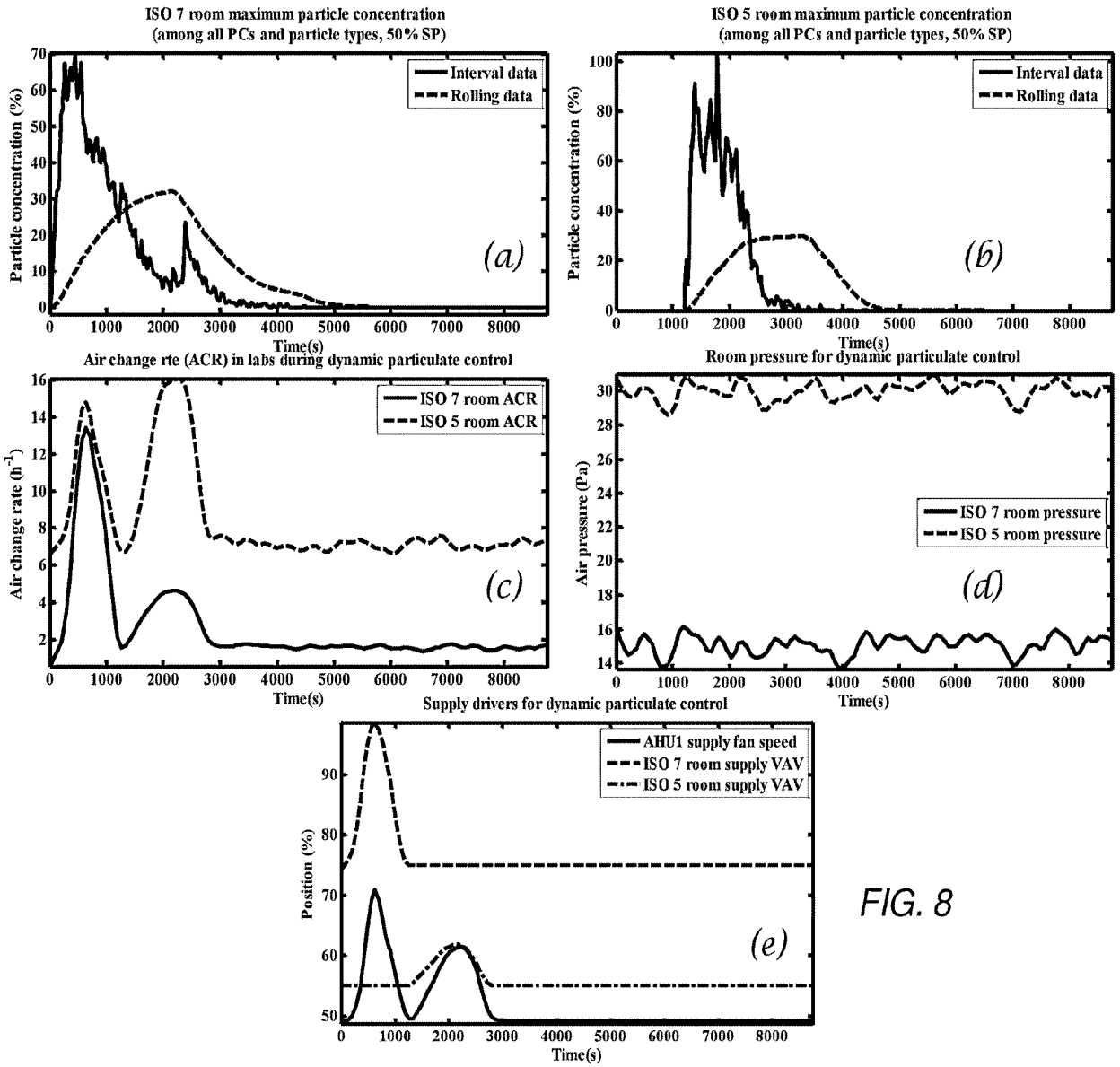
FIG. 8 shows a graph illustration of the dynamic response of the cleanroom control system of the present invention in response to the same experimental test of FIGS. 5 and 6, based on a second optimal setting value.

FIGS. 7 and 8 show the dynamic response of the MPC controller 10 of the present invention to the same experimental test protocol as set out in Table 1, when the desired particle concentration set-points are set at 20% and 50%, respectively. These dynamic test results were obtained with the MPC controller 10 implemented in a PLC platform. The measured values from the particle counters are transferred into percentage values which is calculated against the particle limitations defined in the classifications. Room 124, which is designed as a class 7 cleanroom, has a limitation of 3,520,000 0.5 μm particles and 29,000 5 μm particles per cubic meter. Room 130, which is designed as a class 5 cleanroom, has a limitation of 352,000 0.5 μm particles and 2,900 5 μm particles per cubic meter.

FIGS. 7(*a*) and 8(*a*) show the ISO 7 room 124 0.5 μm and 5 μm particle concentrations; and FIGS. 7(*b*) and 8(*b*) show the ISO 5 room 130 0.5 μm and 5 μm particle concentrations, and it is clear from both that an improved dynamic response is obtained.

FIGS. 7(*c*) and 8(*c*) show the dynamic control of the air change rates in the ISO 7 room 124 and ISO 5 room 130, and again it can be seen that the ACR ramp ups rapidly when there are particles in the rooms 124, 130, as expected.

FIGS. 7(*d*) and 8(*d*) show the static room pressure for the ISO 7 room 124 (15 Pa) and the ISO 5 room 130 (30 Pa). The pressures are controlled within the process range ±5 Pa, except when the door 110 is open and close. The minimum differential pressure (DP) is monitored and alarmed in this system 10 and is determined to be 5 Pa for the ISO 7 room 124 and 15 Pa for the ISO 5 room 130, separated with airlocks 126, 128 to maintain DP during personal and material transitions. DP values higher than 5 Pa provide sufficient overflow on one side. The static pressure set-points of the cleanrooms are designed as 15 Pa in the ISO 7 room 124 and 30 Pa in the ISO 5 room 130. The system recovers from the peak to steady state in a very short time.

FIGS. 7(*e*) and 8(*e*) show dynamic control of the AHU 12*a* (AHU1) supply fan and the supply VAV 42 of each room 124, 130 and shows a good dynamic response when the particle concentration is higher than the set-point.

The dynamic response of the MPC controller (FIGS. 7 and 8) is much better that is obtained from the known BMS 50 control system (FIGS. 5 and 6).

Figure 9:
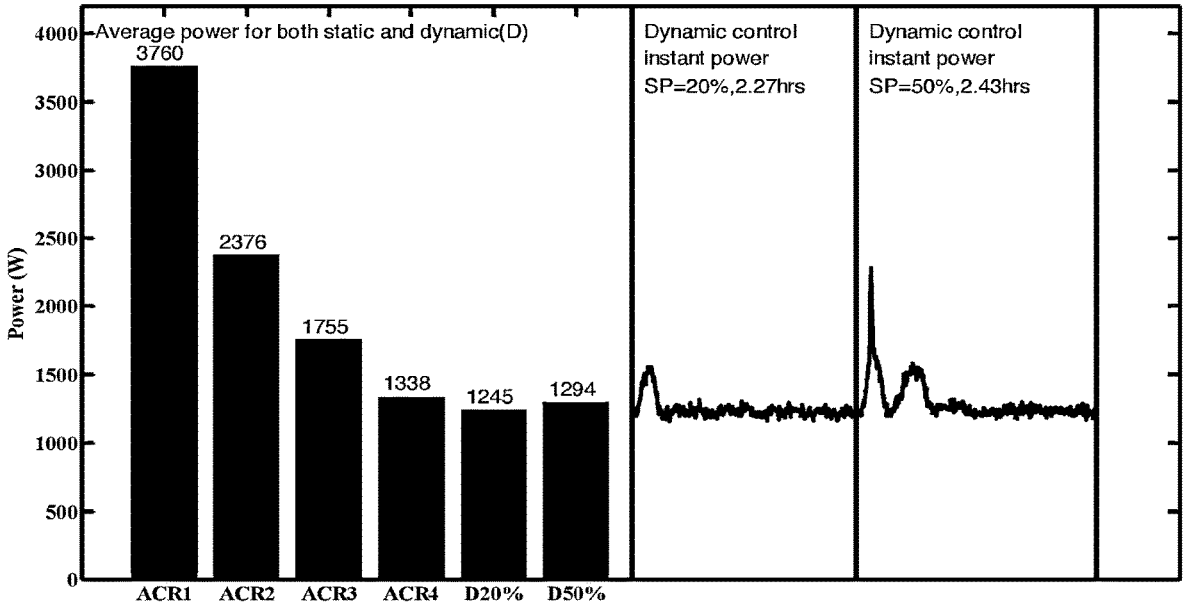
FIG. 9 shows a graph illustration of the power consumed by a known BMS system at various air change rates obtained from the cleanroom of FIG. 4 as well as comparative dynamic power measurements obtained by the cleanroom control system of the present invention and shows that model predictive control significantly reduces the power consumption of the cleanroom HVAC system.

FIG. 9 shows the power consumed by a known BMS 50 system at various air change rates (ACR) obtained from the typical cleanroom 100 of FIG. 4, as set out in Table 2.

TABLE 2

Air change rates of typical cleanroom 100 as depicted in FIG. 9

| No. | ISO 7 room ACR (/h) | ISO 5 room ACR (/h) |
|---|---|---|
| ACR1 | 17 | 40 |
| ACR2 | 13 | 30 |
| ACR3 | 8 | 20 |
| ACR4 | 3 | 10 |

All the fans are controlled in steady state which give steady powers, and the figures demonstrate the average power consumed at each ACR of the known BMS 50 system.

The right hand portion of FIG. 9 is comparative dynamic power measurements obtained by the MPC controller 10 of the present invention and shows that model predictive control significantly reduces the power consumption of the cleanroom HVAC system. It can be clearly seen that the power drawn by the MPC controller 10 is significantly less the steady state ACR of the known BMS 50 system.

TABLE 3

Consumed energy for MPC and BMS 50 control, as depicted in FIG. 9

| | 20%, Set-point | 50%, Set-point |
|---|---|---|
| Duration (hours) | 2.27 | 2.43 |
| Dynamic Energy (KWh) | 2.82 | 3.14 |
| ACR1 energy (KWh) | 8.52 | 9.14 |
| ACR2 energy (KWh) | 5.38 | 5.78 |
| ACR3 energy (KWh) | 3.98 | 4.27 |
| ACR4 energy (KWh) | 3.03 | 3.25 |

The consumed energy for each test is calculated as shown in Table 3. The energy consumption of the dynamic control is calculated by the integral of power (from the power curve in FIG. 9) against time. Since the BMS 50 system operates in steady state, the power is assumed to be static. The energy consumption of the known BMS 50 system is calculated by the multiplication of the static power and the time duration of the dynamic control. As shown in Table 3, the dynamic control consumes lower energy than the known BMS 50 system whatever the air change rate (ACR) the system maintains.

The system of the present invention is flexible enough to be expanded, and/or altered as the cleanroom 100 requirements change. The control system 10 is completely scalable for a single cleanroom 100 to multiple rooms or zones within multiple cleanrooms 100. Furthermore, no use of a system of this nature has ever been produced or hinted at in any printed publication of a system of the purpose generally for industrial use within existing cleanrooms or bespoke cleanrooms and which provides advances in continuously based sensor control of cleanrooms.

The present invention provides a method to control cleanroom conditions which overcomes or reduces the drawbacks associated with known cleanrooms. The method can be implemented with HVAC systems connected to the cleanroom by retrofitting. Even components of the HVAC system can be parts of an existing building management system (BMS). The present invention can save 50% or more of energy and costs while maintaining the ISO classifications for a cleanroom. The operations, including ventilation, heating, cooling, room pressure, and filtration, can be integrated in the method of the present invention.

The present invention innovates model predictive control for the particularities of a cleanroom. The primacy of the occupancy status over the HVAC system conditions addresses the uniqueness of controlling cleanroom conditions. Additionally, the reliance on zone particle concentration, instead of air flow exchange, allows a multiple factor determination of the desired zone particle concentration and control signal beyond the prior art. The method of the present invention is compatible with both continuous real time and time intervals.

The present invention includes a computer processor as a control unit or MPC controller for complex algorithms developed to take into account cleanroom usage, demand and user activities and/or energy prices. The modeling program of the MPC control self-adapts for maintaining the area or zone of the cleanroom in the required condition in the most energy efficient and cost effective manner.

The method to control cleanroom conditions includes determining a desired zone particle concentration and a control signal to the HVAC system based on occupancy status, zone particle concentration, and the desired zone particle concentration. The present invention provide a method to control cleanroom conditions.

The invention is not intended to be limited to the details of the embodiments described herein, which are described by way of example only. Various additions and alternations may be made to the present invention without departing from the scope of the invention. For example, although particular embodiments refer to implementing the present invention as a HVAC cleanroom control system this is in no way intended to be limiting as, in use, the present invention can be used with many types of industrial environments. It will be understood that features described in relation to any particular embodiment can be featured in combination with other embodiments.

The features disclosed in the foregoing description, or the following claims, or the accompanying drawings, expressed in their specific forms or in the terms of a means for performing the disclosed function, or a method or process for attaining the disclosed result, as appropriate, separately, or in any combination of such features, can be utilized for realizing the invention in diverse forms thereof.

We claim:

1. A method to control cleanroom conditions, the method comprising the steps of:

detecting a first zone particle concentration in a zone of a cleanroom with a particle sensor within said zone of said cleanroom;

detecting a first occupancy status in said zone of said cleanroom with an occupancy sensor within said zone of said cleanroom;

detecting heating, ventilation, and air conditioning (HVAC) system conditions in said zone of said cleanroom with a plurality of HVAC sensors, wherein said cleanroom is comprised of an HVAC system in communication with said zone of said cleanroom and with a computer processor, and wherein said particle sensor, said occupancy sensor and said plurality of HVAC sensors are in communication with said computer processor;

communicating said first zone particle concentration, said first occupancy status, and the HVAC system conditions to said computer processor;

determining a first desired zone particle concentration in said zone based on a range of desired HVAC system conditions according to said first occupancy status with said computer processor;

determining a first control signal to the HVAC system based on said first occupancy status, said first zone particle concentration, and said first desired zone particle concentration;

communicating said first control signal to the HVAC system;

activating the HVAC system according to said first control signal;

detecting a second zone particle concentration in said zone of said cleanroom with said particle sensor within said zone of said cleanroom, after the step of activating the HVAC system according to said first control signal;

detecting a second occupancy status in said zone of said cleanroom with said occupancy sensor within said zone of said cleanroom;

detecting second HVAC system conditions in said zone of said cleanroom with said plurality of HVAC sensors;

communicating said second zone particle concentration, said second occupancy status, and the second HVAC system conditions to said computer processor:

determining a second control signal to the HVAC system based on said first occupancy status, said second occupancy status, said first zone particle concentration, said second zone particle concentration, said first control signal, and said first desired zone particle concentration when said first occupancy status and said second occupancy status are identical;

communicating said second control signal to the HVAC system; and activating the HVAC system according to said second control signal.

2. The method to control cleanroom conditions, according to claim 1, further comprising the steps of:

detecting a third zone particle concentration in said zone of said cleanroom with said particle sensor within said zone of said cleanroom, after the step of activating the HVAC system according to said second control signal;

detecting a third occupancy status in said zone of said cleanroom with said occupancy sensor within said zone of said cleanroom;

detecting third HVAC system conditions in said zone of said cleanroom with said plurality of HVAC sensors;

communicating said third zone particle concentration, said third occupancy status, and the third HVAC system conditions to said computer processor;

determining a third control signal to the HVAC system based on said first occupancy status, said second occupancy status, said third occupancy status, said first zone particle concentration, said second zone particle concentration, said third zone particle concentration, said first control signal, said second control signal, and said first desired zone particle concentration when said first occupancy status, said second occupancy status, and said third occupancy status are identical;

communicating said third control signal to the HVAC system; and activating the HVAC system according to said third control signal.

3. The method to control cleanroom conditions, according to claim 1, further comprising the steps of:

detecting a third zone particle concentration in said zone of said cleanroom with said particle sensor within said zone of said cleanroom, after the step of activating the HVAC system according to said second control signal;

detecting a third occupancy status in said zone of said cleanroom with said occupancy sensor within said zone of said cleanroom;

detecting third HVAC system conditions in said zone of said cleanroom with said plurality of HVAC sensors;

communicating said third zone particle concentration, said third occupancy status, and the third HVAC system conditions to said computer processor;

determining a second desired zone particle concentration in said zone based on said range of desired HVAC system conditions according to said third occupancy status with said computer processor when said first occupancy status and said second occupancy status is different from said third occupancy status;

determining a second control signal to the HVAC system based on said third occupancy status, said first zone particle concentration, said second zone particle concentration, said third zone particle concentration, said first desired zone particle concentration, said first control signal, said second control signal, and said second desired zone particle concentration;

communicating said third control signal to the HVAC system; and activating the HVAC system according to said third control signal.

4. The method to control cleanroom conditions, according to claim 1, wherein the HVAC system conditions are air flow rate, air pressure, temperature, and humidity.

5. The method to control cleanroom conditions, according to claim 1, wherein the HVAC system is comprised of an air duct, an air handling unit, and an air volume device.

6. The method to control cleanroom conditions, according to claim 5, wherein said air volume device is comprised of a constant air volume device, a variable air volume device or both, and wherein said first control signal corresponds to at least of a group consisting of: said air handling unit, said constant air volume device, and said variable air volume device.

7. The method to control cleanroom conditions, according to claim 6, wherein said first control signal corresponds to drivers for said air handling unit, said constant air volume device, and said variable air volume device.

8. The method to control cleanroom conditions, according to claim 5, wherein said air handling unit is comprised of a pre-filter, a secondary filter, a main air blower, a temperature device and a high-efficiency particulate air (HEPA) filter element.

9. The method to control cleanroom conditions, according to claim 8, wherein a temperature device is comprised of a heating element, a cooling element or both.

10. The method to control cleanroom conditions, according to claim 5, wherein a building management system is comprised of at least one of said air duct, said air handling unit, and said air volume device.

11. The method to control cleanroom conditions, according to claim 1, wherein an HVAC sensor of said plurality of HVAC sensors is selected from a group consisting of: an air flow rate sensor, an air pressure sensor, a temperature sensor, and a humidity sensor.

12. The method to control cleanroom conditions, according to claim 1, wherein the step of determining said first desired zone particle concentration is further based on a predictive model for the HVAC system conditions.

13. The method to control cleanroom conditions, according to claim 1, wherein the step of determining said first desired zone particle concentration is further based on energy savings of the HVAC system.

14. The method to control cleanroom conditions, according to claim 1, wherein the step of determining said first desired zone particle concentration is further based on cost efficiency of the HVAC system.

15. A method to control cleanroom conditions, the method comprising the steps of:

detecting a first zone particle concentration in a zone of a cleanroom with a particle sensor within said zone of said cleanroom;

detecting a first occupancy status in said zone of said cleanroom with an occupancy sensor within said zone of said cleanroom;

detecting heating, ventilation, and air conditioning (HVAC) system conditions in said zone of said cleanroom with a plurality of HVAC sensors, wherein said cleanroom is comprised of an HVAC system in communication with said zone of said cleanroom and with a computer processor, and wherein said particle sensor, said occupancy sensor and said plurality of HVAC sensors are in communication with said computer processor;

communicating said first zone particle concentration, said first occupancy status, and the HVAC system conditions to said computer processor;

determining a first desired zone particle concentration in said zone based on a range of desired HVAC system conditions according to said first occupancy status with said computer processor;

determining a first control signal to the HVAC system based on said first occupancy status, said first zone particle concentration, and said first desired zone particle concentration;

communicating said first control signal to the HVAC system;

activating the HVAC system according to said first control signal;

detecting a second zone particle concentration in said zone of said cleanroom with said particle sensor within said zone of said cleanroom, after the step of activating the HVAC system according to said first control signal;

detecting a second occupancy status in said zone of said cleanroom with said occupancy sensor within said zone of said cleanroom;

detecting second HVAC system conditions in said zone of said cleanroom with said plurality of HVAC sensors;

communicating said second zone particle concentration, said second occupancy status, and the second HVAC system conditions to said computer processor;

determining a second desired zone particle concentration in said zone based on said range of desired HVAC system conditions according to said second occupancy status with said computer processor when said first occupancy status is different from said second occupancy status;

determining a second control signal to the HVAC system based on said second occupancy status, said first zone particle concentration, said second zone particle concentration, said first desired zone particle concentration, said first control signal, and said second desired zone particle concentration;

communicating said second control signal to the HVAC system; and activating the HVAC system according to said second control signal.

16. The method to control cleanroom conditions, according to claim 15, wherein the HVAC system conditions are air flow rate, air pressure, temperature, and humidity.

17. The method to control cleanroom conditions, according to claim 15, wherein the HVAC system is comprised of an air duct, an air handling unit, and an air volume device.

18. The method to control cleanroom conditions, according to claim 15, wherein an HVAC sensor of said plurality of HVAC sensors is selected from a group consisting of: an air flow rate sensor, an air pressure sensor, a temperature sensor, and a humidity sensor.

19. The method to control cleanroom conditions, according to claim 15, wherein the step of determining said first desired zone particle concentration is further based on a predictive model for the HVAC system conditions.

20. The method to control cleanroom conditions, according to claim 15, wherein the step of determining said first desired zone particle concentration is further based on energy savings of the HVAC system.

* * * * *